US005755315A

United States Patent [19]

Wallbaum et al.

[11] Patent Number: 5,755,315

[45] Date of Patent: May 26, 1998

[54] HANDRAIL DRIVE FOR A PASSENGER CONVEYOR

[75] Inventors: Knuth Wallbaum, Wunstorf; Jörg Ostermeier, Stadthagen; Kurt Pietsch, Minden, all of Germany

[73] Assignee: Otis Elevator Company, Farmington, Conn.

[21] Appl. No.: 497,184

[22] Filed: Jun. 30, 1995

[51] Int. Cl.[6] ..... B66B 23/04

[52] U.S. Cl. ..... 198/331; 198/330

[58] Field of Search ..... 198/329, 330, 198/331, 336

[56] References Cited

U.S. PATENT DOCUMENTS

| | | | |
|---|---|---|---|
| 3,049,213 | 8/1962 | Fabula | 198/331 X |
| 3,321,060 | 5/1967 | Mullis et al. | 198/16 |
| 3,365,051 | 1/1968 | Mullis et al. | 198/330 X |
| 3,749,224 | 7/1973 | Engeler | 198/331 |
| 4,775,044 | 10/1988 | Höfling | 198/330 |
| 5,125,494 | 6/1992 | Nurnberg et al. | 198/330 X |
| 5,522,492 | 6/1996 | Spriggs et al. | 198/331 |

FOREIGN PATENT DOCUMENTS

| | | | |
|---|---|---|---|
| 0810992 | 4/1969 | Canada | 198/331 |
| 0015285 | 2/1979 | Japan | 198/331 |
| 6606660 | 12/1966 | Netherlands | 198/329 |

*Primary Examiner*—James R. Bidwell

[57] ABSTRACT

A handrail drive for a passenger conveyor includes a drive belt that does not encompass either the main drive shaft or the handrail drive shaft. In a particular embodiment, the drive belt includes a plurality of outwardly extending teeth and is formed from a reinforced elastomeric material. The teeth are engaged with complementary toothed extensions on the main and handrail drive shafts. Two pair of deflection rollers maintain contact between the drive belt and drive shafts and an adjustable spring maintains tension in the drive belt.

12 Claims, 3 Drawing Sheets

HANDRAIL DRIVE FOR A PASSENGER CONVEYOR

TECHNICAL FIELD

This invention relates to passenger conveyors, and more particularly to handrail drives for such conveyors.

BACKGROUND OF THE INVENTION

A typical handrail drive for a passenger conveyor includes pair of drive wheels connected by a shaft. The drive wheels are engaged with the handrail to provide the motive force on the handrails. The shaft is driven by a drive chain that interconnects the main drive shaft and the handrail shaft via a sprocket fixed to each shaft. In this way the steps or pallets of the passenger conveyor and the handrail are driven at the same speed.

The handrail drive is a common source of problems and frequent maintenance with the passenger conveyor. The drive chain and sprockets on the shafts require constant lubrication in order to maintain proper operation and to minimize wear. This necessary task increases the maintenance cost of the passenger conveyor. Even with proper lubrication, the chains wear with use. The wear introduces additional vibration and noise during the operation of the passenger conveyor. Eventually the chain must be replaced. Removing the worn drive chain and replacing it with a new chain is a time consuming and costly task. Obviously, during the replacement the passenger conveyor is not operational, which is an inconvenience for the potential passengers.

The above art notwithstanding, scientists and engineers under the direction of Applicant's Assignee are working to develop handrail drives having minimal maintenance costs and vibration.

DISCLOSURE OF THE INVENTION

According to the present invention, a handrail drive includes a drive belt that is engaged with, but does not encompass, the main drive shaft or the handrail drive shaft.

Maintainability of the handrail drive is enhanced as a result of the drive belt not encompassing either of the drive shafts. The drive belt may be easily removed and replaced without interference from the drive shafts.

According to a particular embodiment of the present invention, the handrail drive includes a pair of drive wheels engaged with each of the handrails, a shaft connecting the drive wheels, and the drive belt engaged with the handrail drive shaft and the main drive shaft. The drive belt is formed from an elastomeric material and includes outwardly extending teeth that are engaged with complementary teeth on the drive shafts. Two pair of deflection rollers are engaged with the drive belt. The first pair is positioned adjacent to the main drive shaft to ensure sufficient engagement between the drive belt and the main drive shaft teeth. The second pair are positioned adjacent to the handrail drive shaft to ensure sufficient engagement between the drive belt and the handrail drive shaft. An adjustable belt tensioning device is also engaged with the drive belt.

The particular embodiment produces the advantage of a handrail drive having reduced vibration and noise associated with its operation. The particular configuration provides an opportunity to use smaller pitch teeth as compared to the practical limitations imposed on the use of drive chains of the prior art. The smaller pitch minimizes the resulting vibrations. In addition, the particular embodiment does not require lubrication and this feature minimizes the cost of maintaining the handrail drive as compared to chain driven handrail drives that require lubrication.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
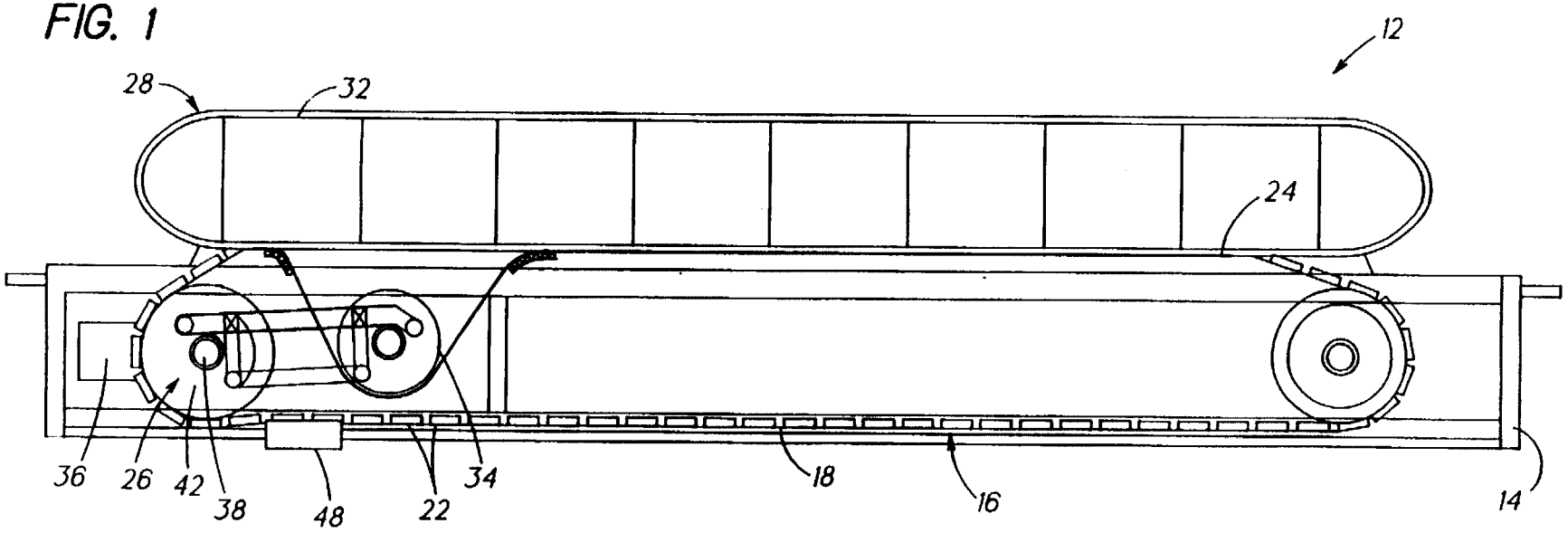
FIG. 1 is a side view partially cut-away of a moving walk.

FIG. 1 illustrates a moving walk 12 that includes a truss 14, a pallet assembly 16 having a pallet chain 18 and a plurality of sequentially connected pallets 22 that form a continuous loop, a portion of which is exposed to provide a passenger conveying surface 24, a main drive 26 for the pallets 22, and a pair of balustrades 28 extending up both sides of the pallets 22. Each of the balustrades 28 includes a handrail 32 over the outer edge of the balustrade 28. A handrail drive 34 for moving the pair of handrails 32 is disposed in the truss 14.

The main drive 26 includes a machine 36 for providing motive force, a main drive shaft 38 driven by the machine 36, and a pair of drive sprockets 42 disposed on the ends of the main drive shaft 38. Each of the sprockets 42 is engaged with the pallet chain 18. Rotating of the main drive shaft 38 and sprockets 42 results in motion of the pallet assembly 16 through its path of travel.

Figure 2:
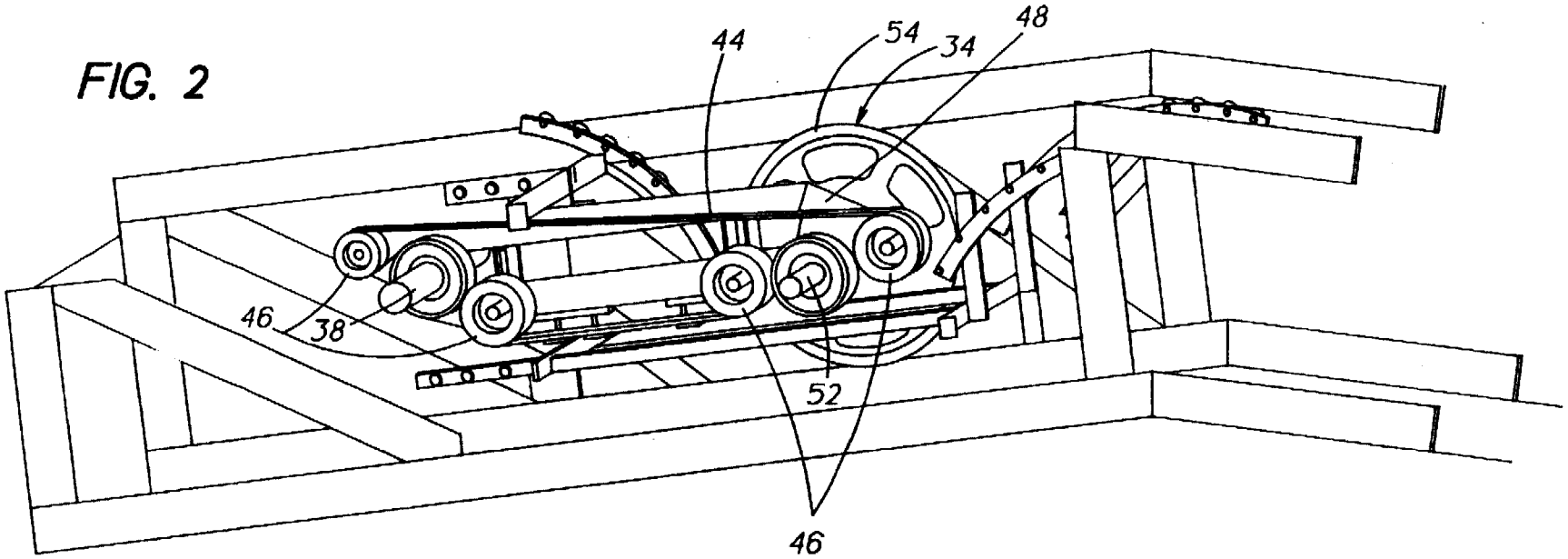
FIG. 2 is a perspective view of a handrail drive for the moving walk.

Referring to FIG. 2, the handrail drive 34 includes a drive belt 44, two pair of deflection rollers 46, tensioning means 48, a handrail drive shaft 52, and a pair of handrail drive wheels 54 disposed on the ends of the handrail drive shaft 52. The drive belt 44 interconnects the main drive shaft 38 and the handrail drive shaft 52 for synchronous motion of the pallet assembly 16 and the pair of handrails 32. The handrail drive wheels 54 provide means to engage the handrails 32 in a conventional manner to transfer motive force to the handrails 32.

Figure 4:
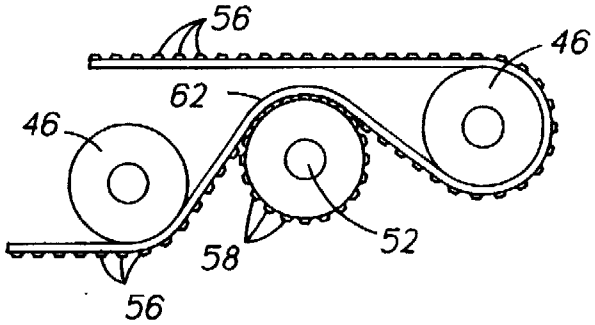
FIG. 4 is a side view of the engagement of the drive belt, shaft and deflection rollers.

The drive belt 44 is a reinforced elastomer belt having outwardly directed teeth 56. The toothed outer surface of the drive belt 44 is engaged with complementary toothed extensions 58 on each of the shafts 38,52 (see FIG. 4). The size and pitch of the teeth will vary dependent upon the specific application. It should be noted, however, that minimizing the tooth pitch should minimize the level of vibration and noise associated with the operation of the handrail drive. The inner surface 62 of the drive belt is engaged with each of the deflection rollers 46.

The deflection rollers 46 are mounted on the tensioning means 48 for rotation and orient the belt 44 for sufficient contact with the toothed extensions 58 of the shafts 38,52. Sufficient contact is defined as engagement between the drive belt 44 and drive shafts 38,52 without slipping and without undue wear of the drive belt 44.

Figure 3:
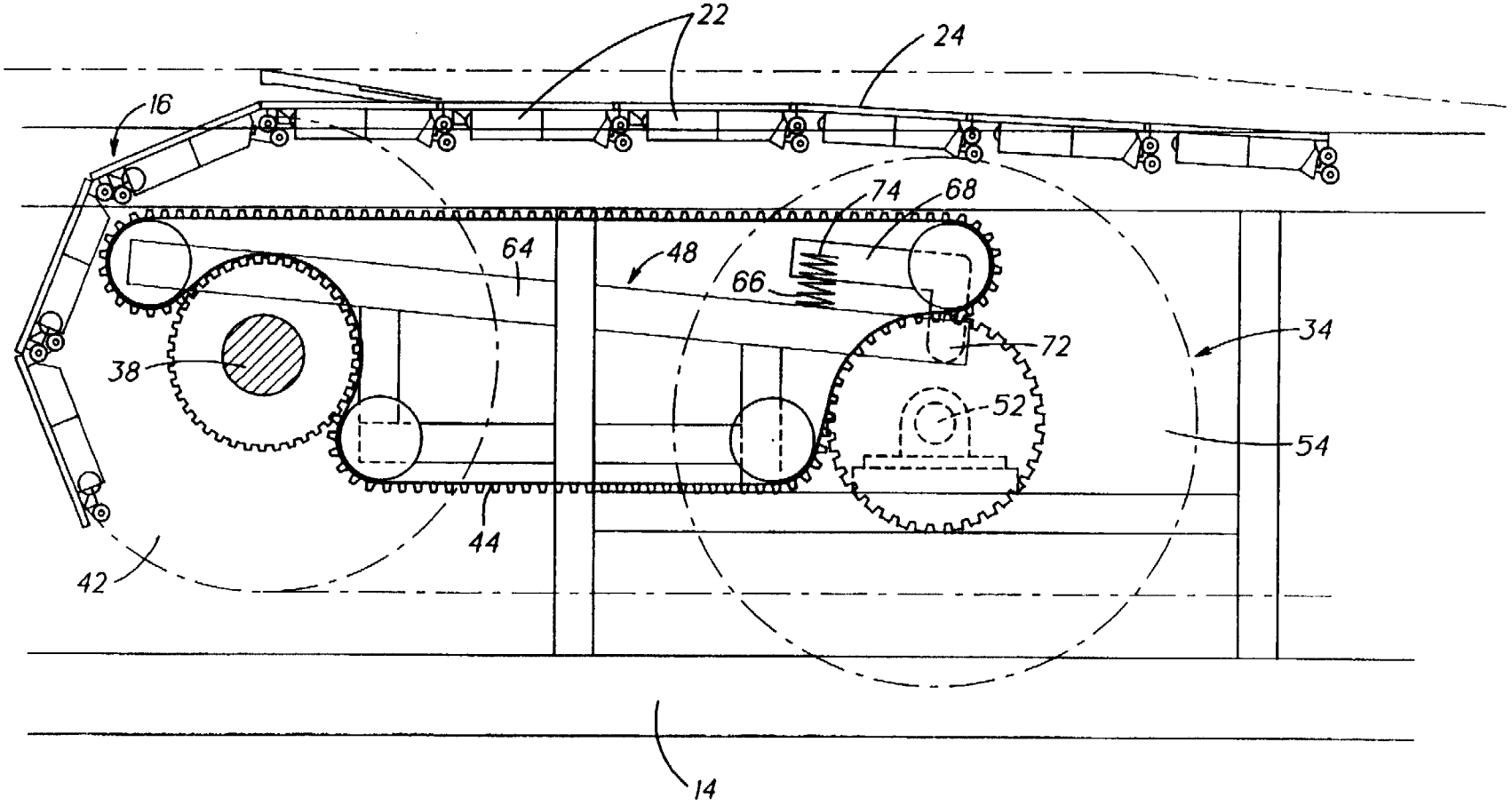
FIG. 3 is a side view of the handrail drive.

Referring to FIG. 3, the tensioning means 48 includes a frame 64, an adjustable spring 66, and an arm 68. The frame 64 supports the deflection rollers 46 and the spring 66. The arm 68 includes one end 72 mounted for pivoting motion on the frame 64 and the opposite end 74 engaged with the spring 66. One of the deflection rollers 46 is mounted on the arm 68. The spring 66 provides a force urging the arm 68 to pivot about the first end 72. This pivoting force provides a constant tension force on the drive belt 44. Since the spring 66 is adjustable in a conventional manner, the tension of the drive belt 44 may be varied by adjusting the spring force. The proper amount of tension will depend on the type of drive belt, the dimensions of the teeth, and the engagement between the drive belt and the shaft. Too little tension may result in slipping of the drive belt on the shafts; too much tension may result in inordinate wearing of the drive belt.

Removal and installation of the drive belt 44 may be performed in the following manner. Since the handrail drive 34 is centrally located in the truss 14, one or more pallets 22 are removed from the pallet assembly 16 to provide access to the handrail drive 34. The drive belt 44 may then be removed by loosening one of the deflection rollers 46 until the belt 44 may be slid off the deflection roller 46. The deflection roller 46 mounted on the arm 68 may be used for this step by adjusting the spring 66 to remove tension from the drive belt 44. The drive belt 44 is then disengaged from the other rollers 46 and the toothed extensions 58. As a result of the drive belt 44 not encompassing either of the drive shafts 38,52, the belt 44 does not have to be cut nor do the drive shafts 38,52 have to be removed.

Installation of the new drive belt 44 will follow the same steps except in the opposite order. The new drive belt 44 is engaged with the toothed extensions 58 and the deflection rollers 46. The adjustable spring 66 is then adjusted to apply tension to the drive belt 44 until the proper tension is achieved. At that point the installation of the new drive belt 44 is complete. Again, since the drive belt 44 does not encompass the drive shafts 38,52 the installation is simplified because it does not require the removal of the drive shafts 38,52. Finally, the pallets 22 removed at the beginning of the process are replaced in the pallet assembly 16.

Maintenance of the handrail drive 34 is also simplified as a result of the drive belt 44 being formed from an elastomeric material. This type of drive means, as opposed to drive chains of the prior art, does not require lubrication during use.

The embodiment shown in FIGS. 1–3 is a moving walk type of passenger conveyor and is used for illustrative purposes only. The handrail drive of the present invention may also be used with other types of passenger conveyors, such as escalators.

Although the invention has been shown and described with respect to exemplary embodiments thereof, it should be understood by those skilled in the art that various changes, omissions, and additions may be made thereto, without departing from the spirit and scope of the invention.

What is claimed is:

1. A handrail drive for a passenger conveyor, the passenger conveyor including a main drive having a main drive shaft, and a pair of handrails, the handrail drive including:

means to engage each of the handrails;

a handrail drive shaft; and a drive belt engaged with both the main drive shaft and the handrail drive shaft for synchronous rotation of the drive shafts, wherein the main drive shaft and the handrail drive shaft are not encompassed by the drive belt.

2. The handrail drive according to claim 1, wherein the means to engage each of the handrails includes a pair of drive wheels, each of the drive wheels engaged with one of the pair of handrails, and wherein the handrail drive shaft extends between the drive wheels.

3. The handrail drive according to claim 1, wherein the main drive shaft and the handrail drive shaft have a plurality of teeth extending outward, and wherein the drive belt has a plurality of teeth extending outward from the drive belt and that are complementary to and engaged with the drive shaft teeth.

4. The handrail drive according to claim 1, wherein the drive belt is formed from an elastomeric material.

5. The handrail drive according to claim 1, further including a first pair of deflection rollers disposed adjacent to the main drive shaft and engaged with the drive belt, a second pair of deflection rollers disposed adjacent to the handrail drive shaft and engaged with the drive belt, and means to tension the drive belt.

6. The handrail drive according to claim 5, wherein the tensioning means is adjustable.

7. A passenger conveyor including a main drive having a main drive shaft, a pair of handrails, and a handrail drive, the handrail drive including:

means to engage each of the handrails;

a handrail drive shaft; and a drive belt engaged with both the main drive shaft and the handrail drive shaft for synchronous rotation of the drive shafts, wherein the main drive shaft and the handrail drive shaft are not encompassed by the drive belt.

8. The passenger conveyor according to claim 7, wherein the means to engage each of the handrails includes a pair of drive wheels, each of the drive wheels engaged with one of the pair of handrails, and wherein the handrail drive shaft extends between the drive wheels.

9. The passenger conveyor according to claim 7, wherein the main drive shaft and the handrail drive shaft have a plurality of teeth extending outward, and wherein the drive belt has a plurality of teeth extending outward from the drive belt and that are complementary to and engaged with the drive shaft teeth.

10. The passenger conveyor according to claim 7, wherein the drive belt is formed from an elastomeric material.

11. The passenger conveyor according to claim 7, further including a first pair of deflection rollers disposed adjacent to the main drive shaft and engaged with the drive belt, a second pair of deflection rollers disposed adjacent to the handrail drive shaft and engaged with the drive belt, and means to tension the drive belt.

12. The passenger conveyor according to claim 11, wherein the tensioning means is adjustable.

* * * * *